United States Patent [19]

Meyer

[11] Patent Number: 4,473,368

[45] Date of Patent: Sep. 25, 1984

[54] METHOD AND MACHINE FOR MANUFACTURING PAPERBOARD TUBES BY HELICAL WINDING AND TUBES OBTAINED BY THE SAID METHOD

[75] Inventor: Jean-Louis Meyer, Coutras, France

[73] Assignee: Abzac S.A. Cartonnages, France

[21] Appl. No.: 316,125

[22] Filed: Oct. 29, 1981

[30] Foreign Application Priority Data

Sep. 14, 1981 [FR] France ..... 81 17332

[51] Int. Cl.[3] ..... B31C 3/00

[52] U.S. Cl. ..... 493/34; 493/299; 493/301

[58] Field of Search ..... 493/301, 299, 300, 24, 493/23, 19, 8

[56] References Cited

U.S. PATENT DOCUMENTS

| | | | |
|---|---|---|---|
| 2,339,219 | 1/1944 | Crowley | 493/299 X |
| 2,716,315 | 8/1955 | Jacoby | 493/299 X |
| 3,068,934 | 12/1962 | Mauck et al. | 493/299 X |
| 3,229,598 | 1/1966 | Yovanovich | 493/299 X |
| 3,398,037 | 8/1968 | Elam et al. | 493/299 X |
| 4,220,077 | 9/1980 | Miller et al. | 493/11 |

FOREIGN PATENT DOCUMENTS

| | | |
|---|---|---|
| 1118128 | 6/1961 | Fed. Rep. of Germany . |
| 1175636 | 6/1964 | Fed. Rep. of Germany . |
| 2549536 | 2/1977 | Fed. Rep. of Germany . |
| 2081031 | 3/1971 | France . |
| 901392 | 5/1982 | United Kingdom . |

*Primary Examiner*—James F. Coan

*Attorney, Agent, or Firm*—Steinberg & Raskin

[57] ABSTRACT

The invention relates to a method and a machine for manufacturing tubes particularly of paperboard or cardboard by helical winding of a strip or of several strips of paper. This machine comprises a stationary frame supporting a stationary winding mandrel, a system for driving in rotation the tube in formation and a movable frame supporting in particular a device for positioning and guiding the paper strips to form a web, this movable frame being connected to the stationary frame by a coupling device in rotation around a swivel pin. This machine comprises operating means for angular displacement of the said movable frame monitored by a preset value of the angle of winding of the web on the stationary mandrel.

12 Claims, 4 Drawing Figures

METHOD AND MACHINE FOR MANUFACTURING PAPERBOARD TUBES BY HELICAL WINDING AND TUBES OBTAINED BY THE SAID METHOD

BACKGROUND OF THE INVENTION

The present invention relates to and has essentially for a subject matter a method for manufacturing tubes particularly of paperboard or cardboard by helical winding of a strip or of several strips of paper, and a machine for carrying out the said method.

It is already known to manufacture paperboard tubes by helical winding of one or several pre-pasted paper or paperboard strips on a stationary mandrel. In this method, the tube in course of formation is driven in rotation about the stationary mandrel.

In this known method, the paper or paperboard strip or the multiple paper or paperboard strips partially overlap and are transversely shifted with respect to one another so as to form a web or the like. Thus, the winding pitch of a paper strip will be a function of the width of the said paper strip, of the mandrel diameter and of the value of the winding angle of the said paper strip formed between the paper strip pay-out direction and the longitudinal axis of the stationary mandrel. Therefore, the characteristics of the manufactured tube depend on the wound paper, but also on the paper strip winding angle.

In order to carry out this known method, use is made of a manufacturing machine comprising a stationary frame bearing the stationary mandrel and a movable frame allowing the paper strip or the web of paper strips to be paid out onto the stationary mandrel along a pay-out direction defined by the desired winding angle. To this end, the movable frame of the known manufacturing machine is mounted so as to swivel round a vertical axis located in the vertical plane of the horizontal longitudinal axis of the mandrel. At the beginning of each manufacturing cycle, the winding angle i.e. the pay-out direction of the paper strips, was adjusted by manually displacing the movable frame.

This method suffers from many drawbacks and requires a protracted, laborious and inaccurate adjustment - to within several degrees - of the winding angle, due particularly to the large dimensions of the movable frame. Moreover, the said adjustment was empirical for it was not possible to accurately measure the angle formed between the fictive swivelling axis of the movable frame and the longitudinal axis of the mandrel. In addition, since the adjustment had to be performed manually, it entailed much labour cost.

SUMMARY OF THE INVENTION

The main purpose of the present invention is to remedy the above drawbacks by providing a manufacturing method allowing the instant winding angle formed between the paper strip payout direction and the mandrel longitudinal axis to be accurately measured and controlled, and moveover the angular displacement of the movable frame to be automatically controlled to obtain an instant winding angle equal to the preset, assigned or predetermined angle. It is thus possible at the beginning of each manufacturing cycle and during the manufacturing cycle to automatically position the movable frame without manual intervention to obtain a given winding angle, without manual intervention on the said movable frame.

To this end, the invention has for a subject matter a method of manufacturing tubes particularly of paperboard by helical winding of a strip or several strips of paper with partial overlapping and transversely shifted with respect to one another thus forming a web, around a stationary mandrel by driving in rotation the tube in formation, characterized in that it consists in regulating automatically and preferably continuously the angle of winding of the said strips of paper defined between the common pay-out direction of the said paper strips and the longitudinal axis of the said mandrel, by measuring the instant winding angle, by comparing the value thus measured of the instant winding angle with a preset value of the said angle, and by performing an angular displacement of the said pay-out direction of the paper strips with respect to the longitudinal axis of the mandrel so that the measured value of the said winding angle be equal to the predetermined set value.

According to another characterizing feature of the method of the invention, the aforesaid web of paper strips is displaced rectilinearly and reversibly along a direction perpendicular to the aforesaid pay-out direction. Thus, the paper strip at one end of the web is wound on the aforesaid stationary mandrel as close as possible to the mandrel support, whatever the chosen winding angle, so as to lose no winding space between the device for driving in rotation the tube in formation and the mandrel support.

The invention also has as a subject matter a machine for carrying out the method described previously and comprising a stationary frame supporting a stationary winding mandrel and a system for driving in rotation the tube in formation, and a movable frame supporting particularly a device for paying out one or several paper strips, a device for pasting the said paper strips and a system for positioning and guiding the said paper strips to form the aforesaid web, the said movable frame being connected to the said stationary frame by a coupling device articulated in rotation around a swivel pin the fictive axis of which perpendicularly cuts the longitudinal axis of the said mandrel, and being mounted so as to roll on rolling paths concentric with the said swivel pin, characterized in that it comprises operating means for angular displacement of the aforesaid movable frame monitored by a preset value of the angle of winding of the said web onto the said stationary mandrel.

According to another characterizing feature of the invention, the aforesaid operating means comprise a device for measuring the instant angle of winding of the paper strips onto the mandrel, the said device emitting a signal corresponding to the measured instant winding angle, a device for adjusting the predetermined set value of the winding angle, a device for comparing the said signal with the said preset value and an operating device controlled by the said comparing device controlling the operation of a motor for reversible driving of at least one driving wheel of the said movable frame.

Advantageously, the axis of the stationary mandrel is substantially horizontal and the aforesaid swivel axis of the movable frame coupling device is substantially vertical.

Furthermore, the device for measuring the aforesaid instant winding angle and the aforesaid device for adjusting the set value are potentiometer devices and the set value is advantageously expressed in winding angle sine.

According to still another characterizing feature of the invention, the aforesaid movable frame is mounted on the aforesaid coupling device in a displaceable manner by transverse rectilinear translation on the said coupling device. Advantageously, this mounting of the movable frame on its coupling device is by means of a screw and nut system actuated by a motor whose operation is synchronized with the aforesaid motor for driving the driving wheel of the said movable frame. Thus, it is possible to displace by transverse rectilinear translation the paper strip with respect to the coupling device and therefore to the stationary mandrel, while at the same time keeping constant the angle of winding of the said paper around the said mandrel.

Furthermore, according to another characterizing feature of the invention, the rotary drive of the tube in formation is constituted by an endless belt wound around the said tube in formation and driven by two drums with a vertical axis perpendicular to the longutinal horizontal axis of the mandrel, carried by a turret possibly movable in translation parallel to the longitudinal axis of the mandrel and/or movable angularly with respect to the said longitudinal axis of the mandrel. The angle formed between the horizontal perpendicular to the longitudinal axis of the mandrel and the line passing through the two vertical axes of the aforesaid drum is adjusted to determine the degree of opening or of closing of the upper turn of the tube.

The invention also has as a subject matter a tube of paperboard manufactured according to the method defined above.

BRIEF DESCRIPTION OF THE DRAWINGS

Other details, advantages, characterizing features of the invention will appear more clearly from the explanatory description made below with reference to the appended diagrammatic drawings illustrating one form of embodiment of the invention, given solely by way of example, and wherein.

DETAILED DESCRIPTION OF PREFERRED EMBODIMENTS

Figure 1:
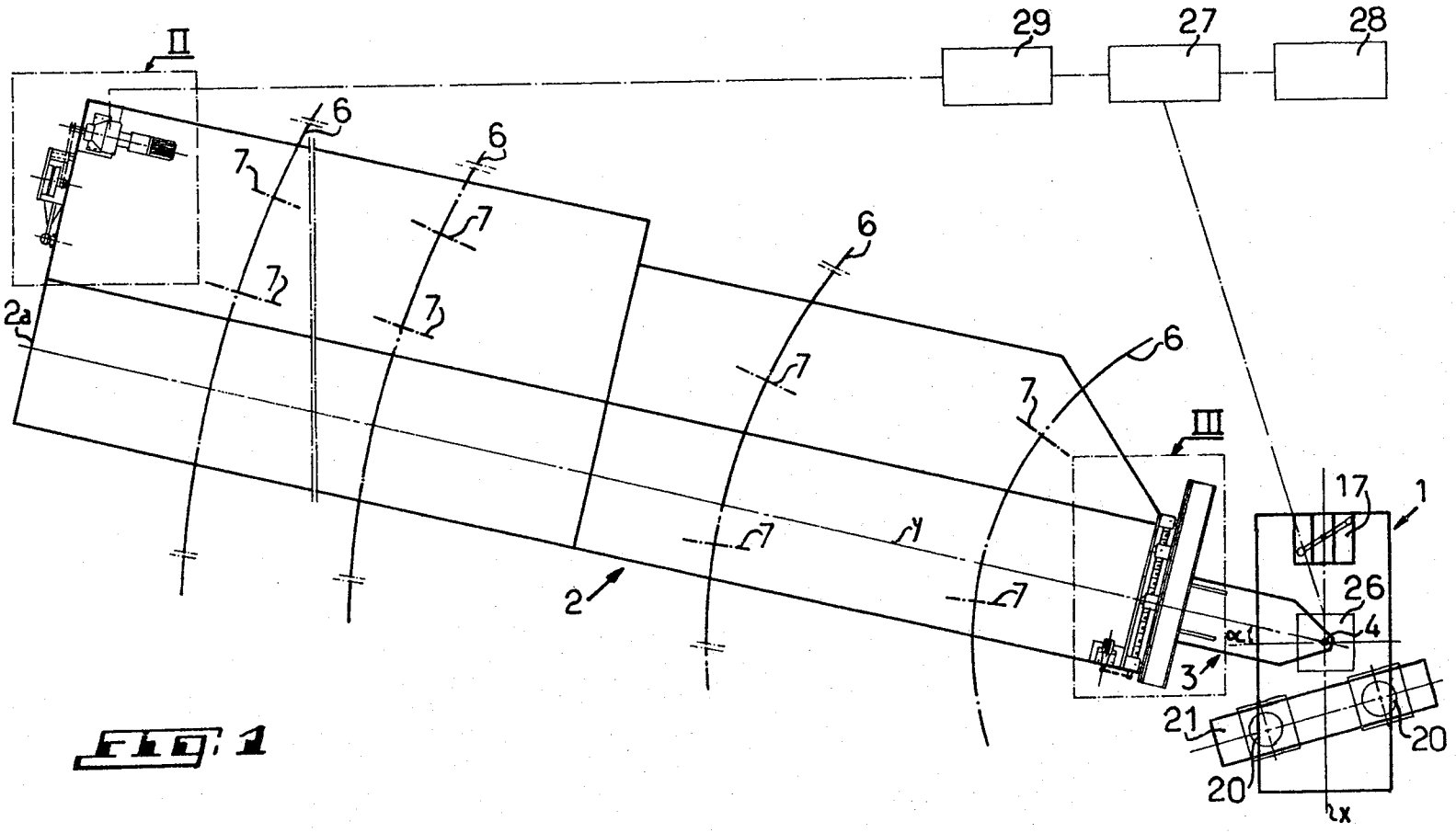
FIG. 1 is a diagrammatic top view illustrating the whole of a manufacturing machine according to the invention.

Referring to FIG. 1, the paperboard tube manufacturing machine comprises, in a conventional manner, a stationary frame 1, and a movable frame 2 connected to the stationary frame 1 by a coupling system 3 such as a metal tiller or the like mounted so as to swivel around a swivel pin 4 fixed to the stationary frame 1 and the axis of which is substantially vertical and perpendicularly cuts the longitudinal axis x of the mandrel 8 which will be described below.

Moreover, the movable frame is mounted so as to roll, by means of wheels 7 shown diagrammatically, on rolling paths or rails 6 concentrically with the swivel pin 4.

The movable frame 2 of the manufacturing machine according to the invention advantageously supports a device for the paying out of a strip or several strips of paper, a device for pasting one of the faces of the said paper strip and a system for positioning and guiding the paper strip or the said paper strips to form a web in which the multiple strips partially overlap and are transversely shifted with respect to one another. Such pay-out and pasting devices as well as the said positioning and guiding system are very well known in the field of paperboard tube manufacture and therefore will not be described in detail and, moreover, are not shown in detail in FIG. 1 for the sake of clarity.

Figure 3:
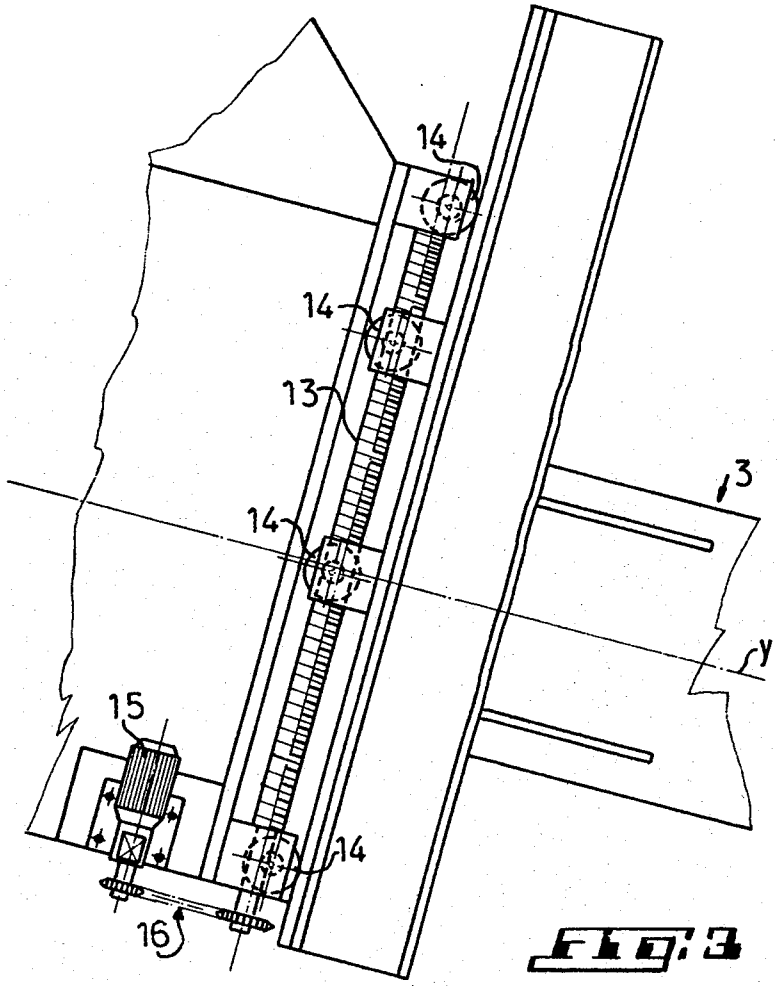
FIG. 3 is a diagrammatic top view to an enlarged scale of the portion III of FIG. 1.
Figure 2:
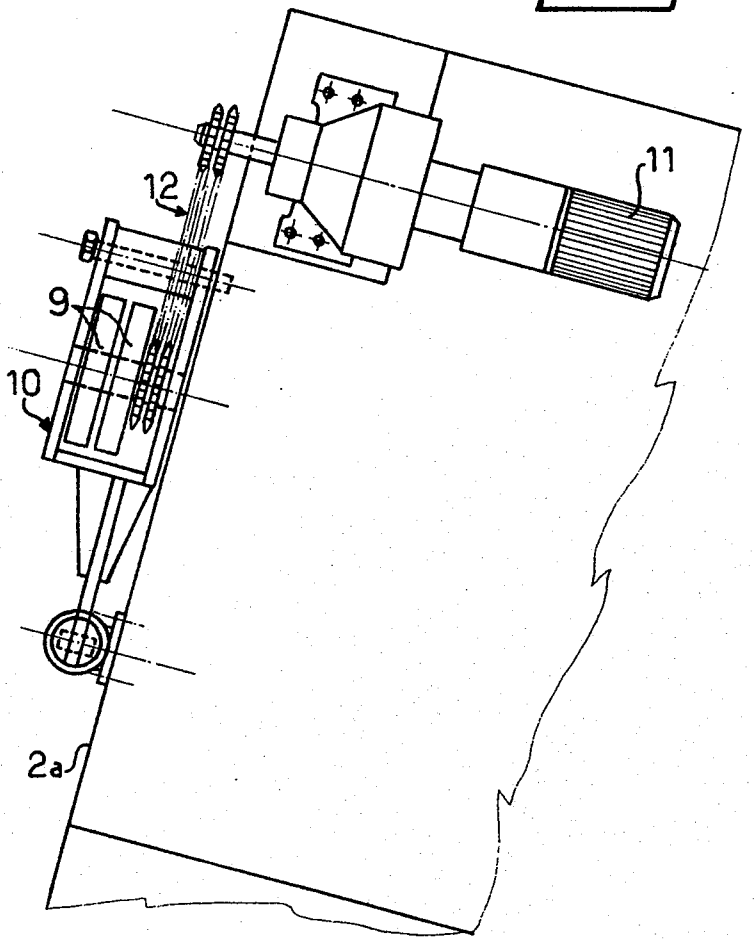
FIG. 2 is a diagrammatic top view to an enlarged scale of the portion II of FIG. 1.

Furthermore, referring to FIGS. 1, 2 and 3 and according to the preferred form of embodiment of the invention, the movable frame 2 comprises two driving wheels 9 attached to its end 2*a* that is not connected to the stationary frame 1 and supporting at least a portion of the said movable frame through the wheel mounting assembly 10. The driving of these wheels is performed by a motor 11, particularly an electric motor, driving a transmission system 12 of, for example, toothed wheels and chains. Thus, the frame 2 can be displaced around the swivel pin 4 on the rails 6 through rotation of the driving wheels 9 driven by the reversible drive motor 11.

Also according to the invention, the movable frame 2 is connected to its coupling device 3 through a screw and nut transmission system comprising an endless screw 13 and rollers 14 driven by the said screw, allowing a rectilinear and transverse translation of the movable frame 2 with respect to its coupling device and therfore with respect to the pay-out direction of the paper web y. The driving of the endless screw is performed by a motor 15, for example a motor-reducer set, and a toothed wheel and chain or pulley and belt transmission system 16.

The operation and control of the motor 11, 15 will be described later.

Figure 4:
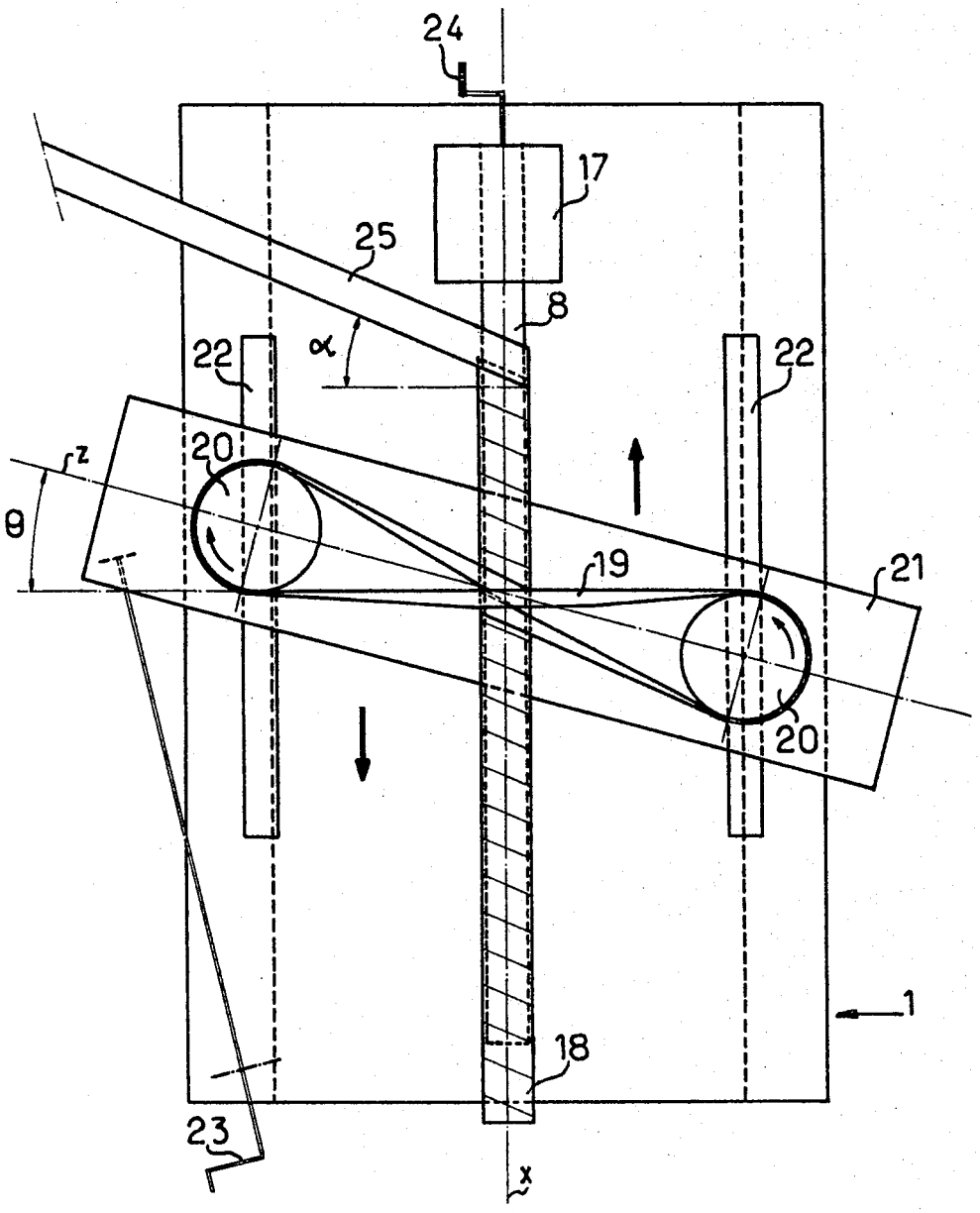
FIG. 4 is a diagrammatic top view of the stationary frame illustrating the helical winding principle according to the invention.

Referring to FIGS. 1, 4 the stationary frame 1 according to the invention comprises a mandrel support 17 preferably attached to one end of the stationary frame 1, a preferably cylindrical mandrel 8 attached to the mandrel support 17 and having a preferably substantially horizontal longitudinal axis x. The mandrel 8 preferably extends over a sufficiently great length to serve as a guiding support for the paperboard tube 18 in formation during its linear displacement towards the end of the mandrel 8.

Moreover, according to the invention, the paperboard tube 18 in formation is driven in rotation by an endless belt 19 wound in a single loop around the tube in formation, preferably with its sides crossed, as illustrated in FIG. 4. This belt is driven by two vertical-axis drums 20 carried by a turret 21 movable on the one hand in translation parallel to the stationary axis of the mandrel 8 on, for example, lateral displacement slide-guides 22, and movable on the other hand in angular position with respect to the longitudinal axis x of the mandrel, so that a straight line z passing through the vertical axes of the drums 20 define an angle $\theta$ in the horizontal plane, with a perpendicular to the longitudinal axis x of the mandrel 8. Advantageously, the angular position of the belt 19 and its lateral position with respect to the mandrel is adjusted manually or automatically by means of, for example, crank handles 23, 24.

It is of course understood that this system for driving in rotation the tube 18 in formation is only given as a preferred form of embodiment of the invention, but any other system allowing the tube 18 in formation to be driven in rotation and allowing the helical winding of the paper strip 25 to be performed may be used in the manufacturing machine according to the invention.

According to the invention, and referring to FIG. 1, the control means for angular displacement of the movable frame 2 with respect to the stationary frame 1 comprise a device, represented diagrammatically at 26, for measuring the angle of winding of the paper around the mandrel 8 or preferably the angle $\alpha$ defined between the preferably substantially horizontal paper pay-out direction y and the perpendicular in the horizontal plane to the longitudinal axis x of the mandrel 8. This device, which is for example a potentiometer device, emits a signal which is applied to a comparing device 27. The comparing device 27 receives a signal from a device 28 for adjusting a preset, assigned or predetermined value of the angle $\alpha$. Advantageously, the set value adjusting device 28 is a potentiometer device calibrated in $\alpha$ sine values. The comparing device emits a signal towards an operating device 29 when the two signals emitted by the measuring device 26 and the set value adjusting device 28, respectively, are not identical. The device 29 controls the operation of the motor 11 for driving the drive wheels 9 and angularly displacing the frame 2 in such a manner that the instant angle $\alpha$ measured by the measuring device 26 corresponds to the preset value of the angle $\alpha$ for which the device 28 is adjusted.

Thus, it appears from the above description that by simply adjusting the device 28 to the desired set value of the sine of the angle $\alpha$, the operating means 28 will automatically ensure a displacement of the movable frame 2 so that the instant angle $\alpha$ measured by the device 26 becomes equal to the set value. Consequently, by simply setting the desired angle $\alpha$, the adjustment of the latter is effected automatically and accurately.

On the other hand, the fact that frame 2 is movable in transverse rectilinear translation on its coupling device 3 allows, for example when changing the winding angle, the paper strip 25 forming the end of the web to be placed as close as possible to the mandrel support 17 to avoid any loss of mandrel length between the mandrel support 17 and the driving belt 19. However, it is necessary, during this transverse rectilinear translation of the movable frame 2 with respect to its coupling 3, to angularly displace the said frame 2 to maintain the winding angle. To this end, the motor 15 for driving the frame 2 in translation operates in a synchronized manner, for example by speed variation with the motor 11 driving the wheels 9.

It is of course possible to provide as driving wheels one or several wheels 7 supporting the frame 2.

Thus, the present invention provides a method which allows regulating automatically, accurately and without manual intervention on the machine the angle of winding of the paper strips around the stationary mandrel 8, and on the other hand, by adjusting the angle $\theta$, i.e. the inclination of the belts with respect to the longitudinal axis x of the mandrel, the degree of opening or closing of the last turn of paper wound on the tube in formation.

The present invention therefore allows automating the operation of a paperboard or cardboard tube manufacturing machine, and mainly, regulating very accurately and very rapidly the angle of winding of the paper round the mandrel, as well as maintaining said angle constant during the whole manufacturing cycle.

It is of course understood that the movable frame 1 may also support all the elements, devices for shaping the paper strips before their winding around the stationary mandrel, and that, on the other hand, said movable frame may support only the system for guiding and positioning the paper strips before the winding to position them along the pay-out direction y.

What is claimed is:

1. A method of manufacturing paperboard or cardboard tubes by helical winding of a strip or several strips of paper partially overlapping and transversely shifted with respect to one another, thus forming a web, around a stationary mandrel by driving in rotation the tube in formation, comprising automatically and continuously regulating the angle of winding of the said paper strips defined between the common direction of pay-out of said paper strips and the longitudinal axis of the said mandrel, by measuring the instant winding angle, by comparing the thus measured value of the instant winding angle with a preset value of the said angle, and by performing an angular displacement of the said common paper strip pay-out direction with respect to the longitudinal axis of the mandrel so that the measured value of the said winding angle be equal to the said preset value.

2. A method according to claim 1, wherein the measuring of the said instant winding angle is performed by measuring the angle defined between said common paper strip pay-out direction and a straight line perpendicular to the longitudinal axis of the mandrel, the said straight line being contained in the plane defined by the said common direction and the said longitudinal axis of the mandrel.

3. A method according to claim 2, additionally comprising rectilinearly and reversibly displacing the aforesaid web of paper strips along a direction perpendicular to the aforesaid common pay-out direction in order that an end paper strip of the said web be wound around said mandrel as close as possible to the mandrel support.

4. A paperboard or cardboard tube, obtained by the method defined in one of claims 1 to 3.

5. A machine for manufacturing paperboard or cardboard tubes by helical winding of a strip or several strips of paper partially overlapping and transversely shifted with respect to one another, thus forming a web, around a stationary mandrel by driving in rotation the tube in formation, comprising a stationary frame supporting the stationary winding mandrel, a system for driving in rotation the tube in formation, and a movable frame supporting particularly a device for paying out one or several strips of paper, a device for pasting the said paper strips and a system for positioning and guiding the paper strips to form the aforesaid web, the said movable frame being connected to the said stationary frame by a coupling device articulated in rotation around a swivel pin whose fictive axis perpendicularly cuts the longitudinal axis of the said mandrel, and being mounted so as to roll on rolling paths concentric with the said swivel pin, wherein said machine comprises operating means for angular displacement of the said movable frame monitored by a preset value of the angle of winding of the said web on the said stationary mandrel.

6. A machine according to claim 5, wherein the aforesaid operating means comprise a device for measuring the instant angle of winding of the paper strips on the aforesaid mandrel, emitting a signal, a device for adjusting the aforesaid set value of the winding angle, a device for comparing the said signal with the said set value and an operating device controlled by the said comparing device for operating a motor for reversible driving of at least one drive wheel of the said movable frame.

7. A machine according to claim 6, wherein the device for measuring the said instant winding angle and the said device for adjusting the set value of the winding angle are potentiometer devices, the said adjusting device is advantageously calibrated in winding angle sines and preferably in sines of the angle $\alpha$ defined between the aforesaid common pay-out direction y and the horizontal perpendicular to the lonitudinal axis x of the aforesaid mandrel, the said measuring device measuring the instant value of the said angle $\alpha$.

8. A machine according to claim 5, wherein the said movable frame is mounted on the said coupling device so as to be displaceable by transverse rectilinear translation on the said coupling device.

9. A machine according to claim 8, wherein the mounting of the movable frame on its coupling is by means of a screw and nut system actuated by a motor for synchronized operation with the motor for driving the drive wheel of the movable frame.

10. A machine according to claim 5, wherein the driving in rotation of the tube in formation is effected by means of an endless belt wound around the said tube in formation and driven by two drums with a vertical axis perpendicular to the longitudinal horizontal axis x of the mandrel, the said drums being carried by a turret movable in translation parallel to the axis x of the mandrel and movable in angular displacement with respect to the longitudinal axis x of the mandrel.

11. A machine according to claim 5, wherein the said angular displacement of the turret of the belt with respect to the axis x of the mandrel is defined by the angle $\theta$ comprised between the straight line z passing through the vertical axes of the drums and the horizontal perpendicular to the longitudinal axis x of the mandrel, the said angle being adjustable by adjusting means to determine the degree of opening or of closing of the upper turn of the tube in formation.

12. A machine according to claim 6, wherein the longitudinal axis x of the said mandrel is substantially horizontal and the swivel axis is substantially vertical.

* * * * *